US005473217A

United States Patent [19]

Hull

[11] Patent Number: 5,473,217

[45] Date of Patent: Dec. 5, 1995

[54] CATHODE-RAY TUBE HAVING MULTIPLE GUN AND DEFLECTION ASSEMBLIES IN AN EVACUATED CHAMBER

[76] Inventor: Otis E. Hull, 6701 Crooked La., Flowermound, Tex. 75028

[21] Appl. No.: 64,837

[22] Filed: May 19, 1993

[51] Int. Cl.[6] ..... H01J 31/20

[52] U.S. Cl. ..... 313/2.1; 313/422

[58] Field of Search ..... 313/2.1, 413, 420–422

[56] References Cited

U.S. PATENT DOCUMENTS

| | | | |
|---|---|---|---|
| 3,071,706 | 1/1963 | Waldorf | 313/70 |
| 3,935,499 | 1/1976 | Oess | 313/413 |
| 4,145,633 | 3/1979 | Peters et al. | 313/422 |
| 4,325,489 | 4/1982 | Russell et al. | 220/2.2 |
| 4,712,038 | 12/1987 | Takenaka et al. | 313/2.1 |
| 4,714,856 | 12/1987 | Takenaka et al. | 313/2.1 |
| 4,900,981 | 2/1990 | Yamazaki et al. | 313/422 |
| 4,994,704 | 2/1991 | Takenaka et al. | 313/2.1 |
| 5,032,756 | 7/1991 | Takenaka et al. | 313/2.1 |
| 5,111,103 | 5/1992 | DuBrucq | 313/2.1 |
| 5,365,142 | 11/1994 | Nishimura et al. | 313/2.1 |

*Primary Examiner*—Stephen Brinich

*Attorney, Agent, or Firm*—Felsman, Bradley, Gunter & Dillon

[57] ABSTRACT

A cathode ray tube device has multiple elements for generating a display. Each of the relatively large number of elements has its own electron gun and deflection assembly. A large number of these subunits are connected into a regular array in which each unit generates a portion of the overall display. The individual gun and deflection assemblies are preferably formed in a framework which serves to both align and position the individual assemblies, and further to provide structural support for the evacuated tube.

10 Claims, 6 Drawing Sheets

CATHODE-RAY TUBE HAVING MULTIPLE GUN AND DEFLECTION ASSEMBLIES IN AN EVACUATED CHAMBER

BACKGROUND OF THE INVENTION

1. Field of the Invention

The present invention relates generally to cathode ray tube displays, and more specifically to designs for a cathode ray tube having multiple electron beam guns.

2. Description of the Prior Art

The cathode ray tube, in general, has a long history as a display device. Initially available as a monochrome display, and later available to display colors using separate controls for red, green and blue, the CRT has been the display device of choice for televisions and similar products such as computer monitors. Although alternative display technologies are now being utilized for television and computer displays, primarily in the area of very small devices, the CRT remains the display technology of choice for many applications.

This is due primarily to the many advantages of available CRT devices. These advantages include screen brightness and resolution. Color reproduction of CRTs is very good, and the drive circuitry required to control them is relatively simple and well understood. CRTs can be manufactured easily, and relatively inexpensively, and have a fairly long product life.

Other technologies are replacing CRTs in some areas, primarily due to limitations of the CRT technology. These limitations include the relatively large front to back dimension, or depth, of a CRT of a given size. Additionally, especially in the larger size devices, the weight of the tube becomes significant. These considerations tend to limit the maximum size of a CRT; an upper limit of approximately 30 to 40 inches, measured diagonally, is about the best that can be achieved using current technology. Current CRT technology also usually requires a curved face plate to withstand atmospheric pressure, especially in the larger sizes.

These limitations have generated significant research into alternative display technologies. Examples of such technology include liquid crystal displays (LCD) and field emission displays (FED). These displays overcome the size and weight limitations of traditional CRT technology, but have limitations of their own. Typically, these limitations are found in those areas which are the strengths of CRT displays. Limitations in alternate technologies typically include brightness and color problems, and manufacturing rejects, particularly with larger size displays.

Numerous attempts have been made to improve CRT technologies to retain its advantages, but to overcome some of its drawbacks. In order to enable larger displays to be built, for example, one approach has been to include multiple electron guns in a single picture tube. These electron guns each sweep a portion of the face of the display, theoretically allowing very large displays to be made.

However, designs along these lines which have been proposed in the past have not been easily manufacturable. Although the theories behind this design approach seem somewhat promising, the practicality of the various designs which have been proposed are too low to make them production-worthy. Therefore, the use of multiple electron gun devices has met with very limited success in the marketplace.

It would be desirable to provide a cathode ray tube device which is inexpensive and easy to manufacture, and which overcomes some the drawbacks of traditional CRT technology. Such a device can preferably be made very large compared to traditional CRT devices, and be provided with a high resolution, flat display. Such an improved device will also preferably have a relatively small depth, allowing fairly thin and light weight devices to be produced.

SUMMARY OF THE INVENTION

It is therefore an object of the present invention to provide a cathode ray tube device which maintains the advantages of traditional technology while overcoming many of its disadvantages.

Therefore, in accordance with the present invention, a cathode ray tube device has multiple elements for generating a display. Each of the relatively large number of elements has its own electron gun and deflection assembly. A large number of these subunits are connected into a regular array in which each unit generates a portion of the overall display. The individual gun and deflection assemblies are preferably formed in a framework which serves to both align and position the individual assemblies, and further to provide structural support for the evacuated tube.

BRIEF DESCRIPTION OF THE DRAWINGS

The novel features believed characteristic of the invention are set forth in the appended claims. The invention itself however, as well as a preferred mode of use, and further objects and advantages thereof, will best be understood by reference to the following detailed description of an illustrative embodiment when read in conjunction with the accompanying drawings, wherein:

DESCRIPTION OF THE PREFERRED EMBODIMENT

Figure 1:
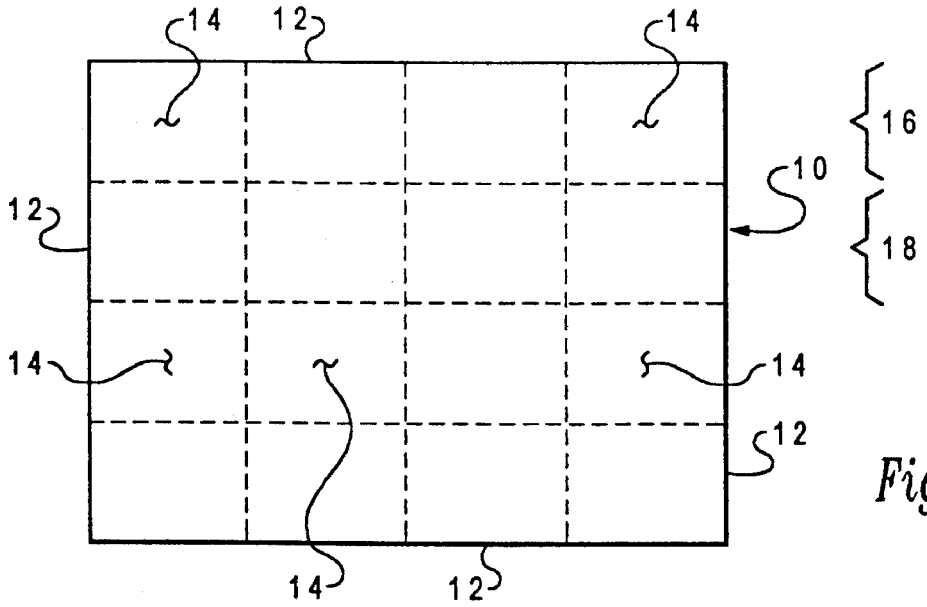
FIG. 1 is a graphical depiction of a CRT display illustrating several concepts of the present invention.
Figure 2:
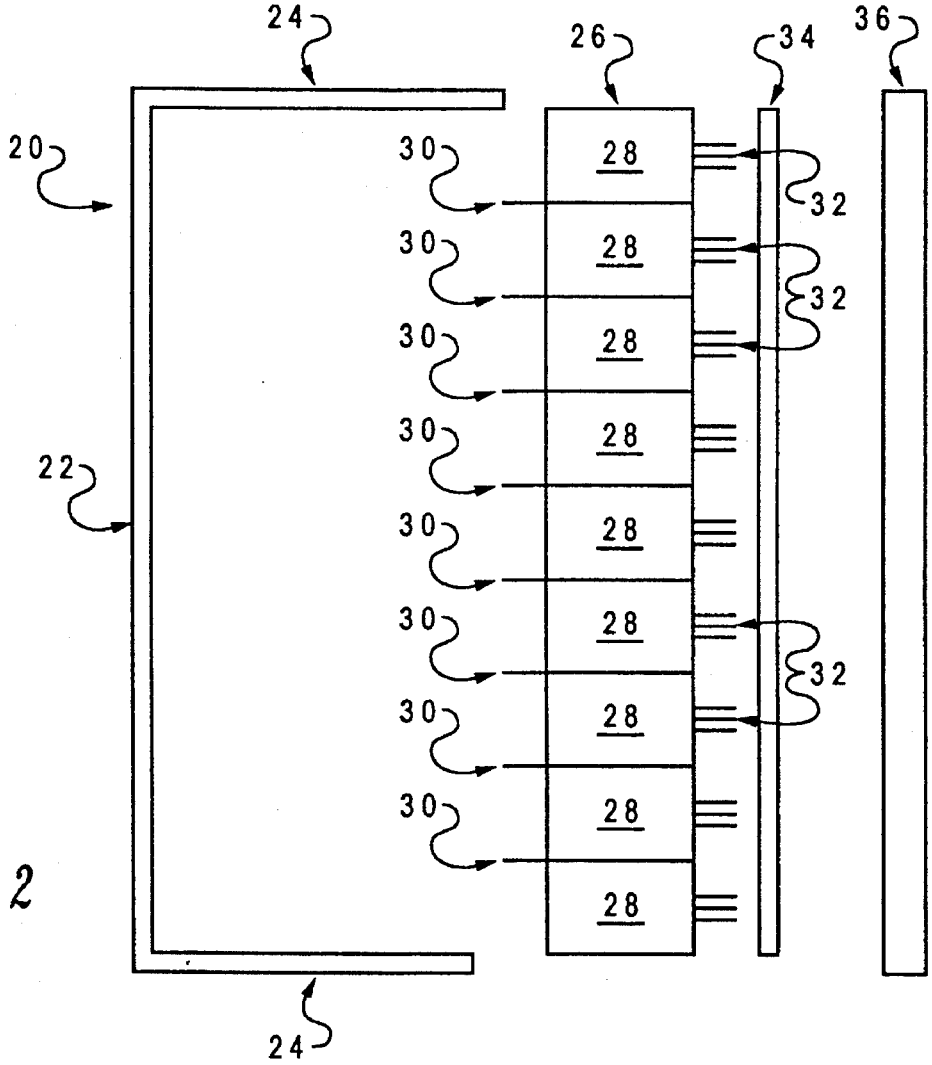
FIG. 2 is an exploded side view of a CRT display assemble in accordance with a preferred embodiment of the present invention.

FIGS. 1 and 2 illustrate the broad concept behind the use of multiple gun CRTs in accordance with the present invention. FIG. 1 represents the front surface of a display 10, with the borders 12 defining the outline of a display region. In accordance with television broadcast standards in the United States, the display 10 has an aspect ratio of 4:3 as shown.

The display 10 is divided into an array of subregions 14. Each of the subregions 14 has the same aspect ratio (4:3 ) as does the overall display 10. Although this simplifies the preferred embodiment, it is not actually necessary for each of the subregions 14 to have the same aspect ratio of the larger display 10. In addition, aspect ratios other than 4:3 may be desirable for use with computer monitors and other applications such as HDTV. For example, HDTV proposed standards provide for a display having a 16:9 aspect ratio. Subregions having a ratio of 8:9 could easily be used to provide such a display by using twice as many subregions for the horizontal direction as for the vertical.

Each of the subregions 14 is generated by a separate gun and deflection assembly as will be described below. Thus, for the example shown in FIG. 1, the 16 subregions 14 are driven by 16 separate gun and deflection assemblies. Each gun "paints" information only in the associated subregion 14 of the screen. For ease of illustration, only displays having a relatively small number of individual gun and deflection assemblies are shown and described. However, those skilled in the art will appreciate that large numbers of small assemblies can be used in accordance with the teachings herein.

The use of multiple, very small, electron guns and deflection assemblies to generate the overall picture for the display 10 has a number of advantages. Each of the gun and deflection assemblies can be significantly smaller and lighter in weight than one large assembly required to paint the entire screen. It is, generally, easier to obtain fine picture resolution with a small display, resulting in an overall resolution improvement for the multi-unit display 10. The use of a large number of gun and deflection assemblies associated with a large number of subregions 14 allows the overall display 10 to be made much larger than is possible with conventional CRT technology.

In addition to the larger and lighter weight display, the display 10 can be made quite bright relative to a single gun and deflection device of the same size. This is done by simply having multiple guns writing to the screen simultaneously, so that a brightness multiplier is achieved equal to the number of guns which are writing simultaneously. For example, the subregions 14 which form row 16 can be writing to the screen at the same time as those of row 18. In the example of FIG. 1, four rows of subregions are provided so that four horizontal scan lines are simultaneously being painted on the display screen. In general, this means that four times as much energy is being imparted to the phosphors of the display screen as in the case of a single line. This provides for a greatly enhanced brightness for the overall display.

Various design tradeoffs can be made in order to take advantage of this effect. For example, less energetic beams can be used in each subregion, which could still result in an above average brightness compared to a conventional CRT, but the reduced beam current will result in less spot blooming, which will result in improved resolution.

If desired, all of the subregions 14 can be scanned simultaneously. This requires a horizontal scan row to be broken up into separate portions according to the numbers of subregions 14 provided. This complicates control somewhat over the approach just described, but provides additional enhancement to the overall display brightness.

FIG. 1 shows the use of only 16 relatively large subregions 14 to generate the overall display 10. However, in the preferred embodiment, a large number of gun and deflection assemblies are used to produce much smaller subregions 14. The individual subregions could be reduced to 3/16×1/4 inch, producing a portable computer display approximately one inch deep. To produce a 9×12 inch computer display screen, a matrix of 48 rows by 48 columns of these small assemblies would be required. This display would have 2034 individual gun and deflection assemblies.

For television screens, a 4 inch deep screen would be satisfactory for hanging on the wall. The individual gun and deflection units would have an area of 0.75 inch×1.0 inch. To make a 60 inch diagonal screen (36×48 inches) would require a 48×48 matrix, which would also have 2304 individual gun and deflection assemblies. When a large number of individual gun and deflection assemblies are required for a display, uniform electrical characteristics between individual assemblies becomes a critical factor, and 6 axis alignment must be maintained for the total assembly of units.

FIG. 2 illustrates a construction for a CRT, according to the present invention, which allows the use of a large number of very small gun and deflection assemblies to be efficiently utilized, and will meet the above critical alignment requirements. An outer envelope 20 includes a face plate 22 and sidewalls 24. Face plate 22 includes red, green and blue phosphor regions and a shadow mask (not shown) to allow the projection of color images as known in the art. A CRT stack 26 includes an array of individual electron gun and deflection assemblies 28 formed into a regular array. Nine gun and deflection assemblies are contained in each column, and an appropriate number of rows extend out of the plane of the drawing to form an array to be slipped into the outer envelope 20. The CRT stack 26 provides support for the sidewalls 24 and back plate 36 when the unit is evacuated, so that the sidewalls and back plate need not be self-supporting. This allows them to be made much thinner than would otherwise be the case. Pins 30 project forward from the CRT stack 26 to make contact with the face plate 22 when the stack 26 is inserted into the outer envelope 20. These pins are preferably located at the corners of the intersections between the individual gun and deflection assemblies 28 and provide the necessary support for face plate 22. This allows face plate 22 to be made of thinner flat glass, rather than curved, and capable of withstanding atmospheric pressure when the device is evacuated.

Connecting pins 32 project rearwardly from each gun and deflection assembly 28. When the unit is assembled, these pins 32 make electrical contact with a printed wiring board 34, allowing control signals to be communicated to the individual gun and deflection assemblies 28. Printed wiring board 34 is preferably used only for routing signals, and need not contain any integrated electronics. Back plate 36 is sealed to the sidewalls 24, providing an airtight structure. A wiring harness (not shown) extends from the printed circuit board 34 through the back plate 36 and is available for external connection. In the preferred embodiment, back plate 36 includes a second printed circuit board (not shown) which contains all of the electronics necessary to interface with the individual gun and deflection units. This printed circuit board can simply contain drivers and adjustment circuitry, if desired, or it may contain more complex electronics. These more complex electronics would allow the complex device to be viewed from the outside world as a simple, standard, CRT. The electronics necessary for converting the standard video signal into separate signals suitable for driving the individual gun and deflection assemblies 28 would then be performed on this second printed circuit board.

Once the entire unit has been assembled, the CRT stack 26 provides a significant fraction of the atmospheric pressure support for the device. The seal between the back plate 36 and sidewalls 24 allows the interior of the device to be evacuated so that the individual gun and deflection assemblies may perform properly. The individual gun and deflection assemblies 28 are not separately evacuated; they simply rest within the CRT stack 26 which is contained within the interior of the larger evacuated chamber.

Figure 3:
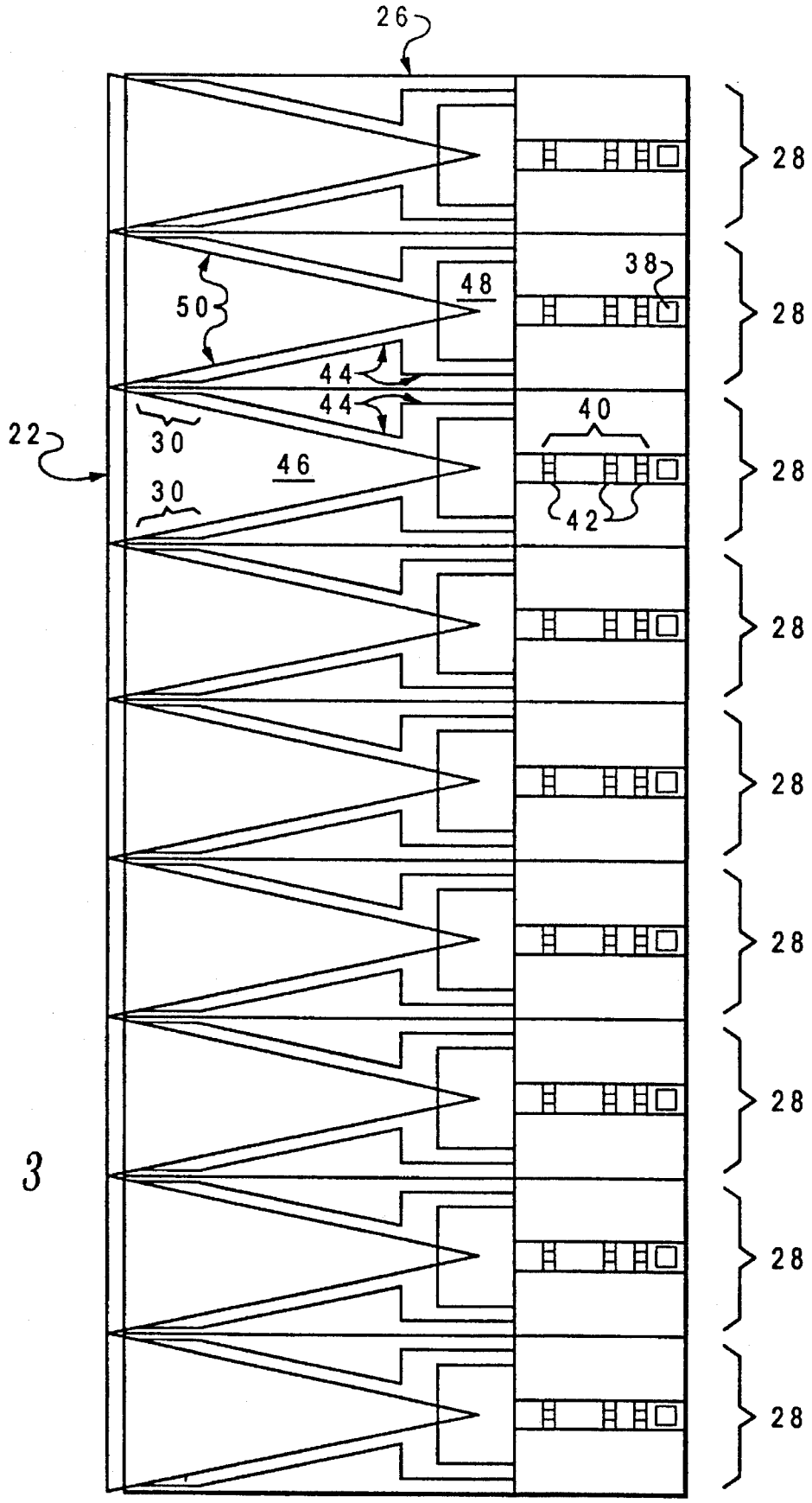
FIG. 3 is a more detailed view of a portion of the assemble of FIG. 2.

Referring to FIG. 3, a more detailed illustration of the CRT stack 26 is shown. The CRT stack 26 is assembled from a number of molded subassemblies, each containing one-half of two adjacent gun and deflection assemblies. Assembly of the array using this approach will be described in more detail in FIG. 4.

FIG. 3 illustrates a stack of nine gun and deflection assemblies 28, matching the illustration of FIG. 2. The individual gun and deflection assemblies 28 are fabricated in accordance with conventional techniques used for fabricating CRT devices. Although a particular implementation is shown for a preferred gun and deflection assembly, it will be apparent to those skilled in the art that other variations may be utilized.

Each gun and deflection assembly 28 contains a cathode followed by a control grid for emitting and controlling the electron beam. Because of the large number of such guns in the overall array, it is preferable to use cold cathode electron guns, as known in the art, to produce the electron beam. This prevents extensive heating of the device.

Each assembly 28 has a first anode 40 to accelerate the electron beam. Within the first anode 40 are two electron lenses to direct and focus the beam.

Each assembly also contains a second anode 44 which overlaps the front portion of the first anode 40, without contact, and continues to the front of the assembly. The second anode 44 further accelerates the electron beam to its final velocity before it strikes the phosphor on the inside of the front screen.

The preferred embodiment uses electrostatic deflection, although magnetic deflection could be used as known in the art. Electrostatic deflection utilizes deflection plates 48 to aim the electron beam. Only a single plate is shown in the drawing of FIG. 3, but pairs of deflection plates, in the X and Y direction, are utilized as known in the art. The lines 50 indicate the limits of the electron beam scanning region after deflection by the deflection plates 48.

FIG. 3 illustrates the CRT stack 26 when located in contact with the face plate 22. Support pins 30 contact the back side of the face plate 22. The pins 30 are located only at the corners of the scanning region for each gun and deflection assembly and between the horizontal sweep lines, so as to minimize interference with the displayed image. As shown in FIG. 3, the beam scanning regions for the individual gun and deflection assemblies converge so as to provide complete coverage of the phosphors on the face plate 22.

Figure 4:
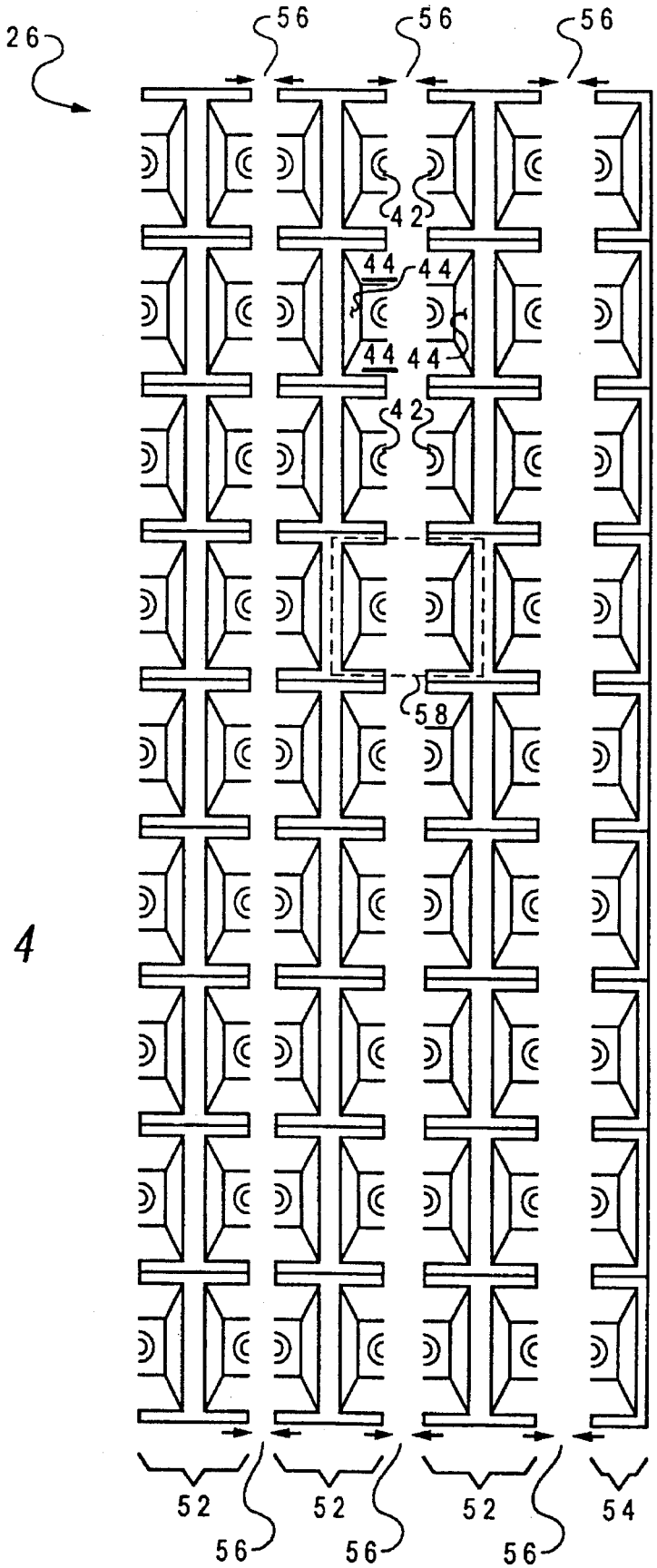
FIG. 4 is a front view of several molded sheets of modular gun and deflection assembly components (single and double half gun and deflection assembly components) for defining an array or gun and deflection assemblies.

FIG. 4 illustrates a front view of a small number of individual sheets used to fabricate the overall assembly. FIG. 4 shows a view of the CRT stack 26 as seen when looking through the face plate 22. A number of separately molded sheets are attached together to form the rectangular array of the CRT stack 26. FIG. 4 illustrates three separate sheets 52 used in the fabrication of the assembly. Each sheet 52 contains two columns of cavity halves. Each cavity one-half is suitable for forming a single gun and deflection assembly when the sheet 52 is paired with a corresponding sheet as shown. A second type of sheet 54 contains only one set of cavity halves, and is used at the end of the array. FIG. 4 illustrates only a small portion of an array; an end piece sheet 54 would of course be necessary at both ends of the array.

Each molded portion 52 is formed from a nonconductive, rigid material such as ceramic. Alternatively, any plastic material which is capable of carrying the atmospheric compression loads to which it will be subjected may be used. Such plastic must maintain its integrity in the vacuum inside of the CRT, without outgassing or becoming brittle.

A series of separate sheets 52 are located adjacently as shown in FIG. 4, and then moved into intimate contact in the directions indicated by arrows 56. Because each sheet 52 contains one-half of a cavity defining a single gun and deflection assembly, joining the sheets 52 together forms a complete single assembly. For example, the dashed box 58 defines a single gun and deflection assembly cavity once the sheets 52 have been assembled together. The single column sheets 54 are used to complete the gun and deflection assemblies on either end of the array.

The various sheets 52, 54 may be affixed together in any appropriate fashion. For example, interlocking pins (not shown) on each sheets 52, 54, combined with an appropriate adhesive for the joints, would be suitable. Any other attachment technique which firmly bonds the sheets into a single rigid structure is suitable for use with the present invention.

As shown in FIG. 4, the sheets are attached together to form an array of any desired size. The individual gun and deflection assemblies can define square regions as shown in FIG. 4, or regions having different aspect ratios as desired. The height of the stack in each of the sheets is not limited to the nine gun and deflection assemblies shown in FIG. 4, and the number of separate sheets 52 which may be utilized will depend entirely upon the desired finished size of the resulting product.

Figure 4A:
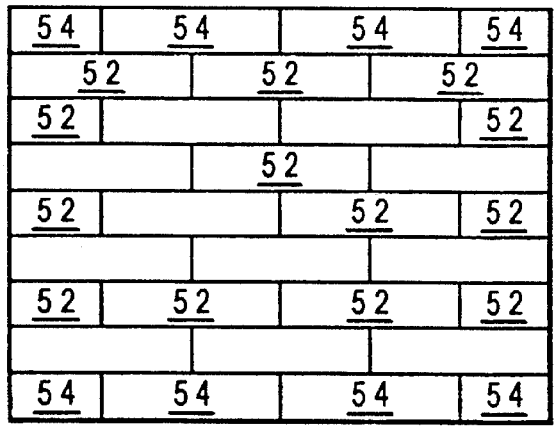
FIG. 4A illustrates a layout pattern for the sheets shown in FIG. 4.

The individual sheets 52 may be oriented in either a horizontal or vertical direction as structural requirements necessitate. FIG. 4A illustrates one preferred assembly scheme. This scheme utilizes an offset pattern similar to standard patterns used for placing bricks and other materials. The middle sections of the display utilize full sheets 52 in the interior, with single column sheets 54 on the top and bottom. On the ends of alternating rows, half length sheets are required. Half length single sided sheets 54 are located at each corner of the display. Half length two-sided sheets 52 are used to finish out alternating rows.

The particular layout shown in FIG. 4A is, of course, just one of many which can be used. In general, the use of an overlapping pattern, with staggered joins, provides greater strength and rigidity to the resulting display after assembly. Typically, the fabrication of individual molded sheets 52 which are long enough to stretch the entire width or height of the display screen will result in each of the sheets being too flimsy for proper structural rigidity and accurate placement of the gun and deflection assemblies. The maximum length of the individual sheets 52 will, of course, be dictated by the stiffness of the material used to form them. With a typical ceramic material, individual sheets having a length of 8 to 12 inches gives a good compromise between the stiffness of each molded sheet 52 and the number of such sheets which are required to be assembled into a single unit.

Figure 5:
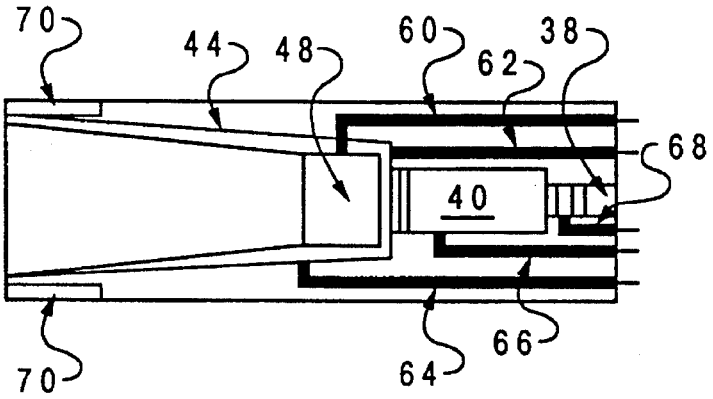
FIGS. 5 and 6 are detailed sectional views illustrating the construction of a single gun and deflection assembly.
Figure 6:
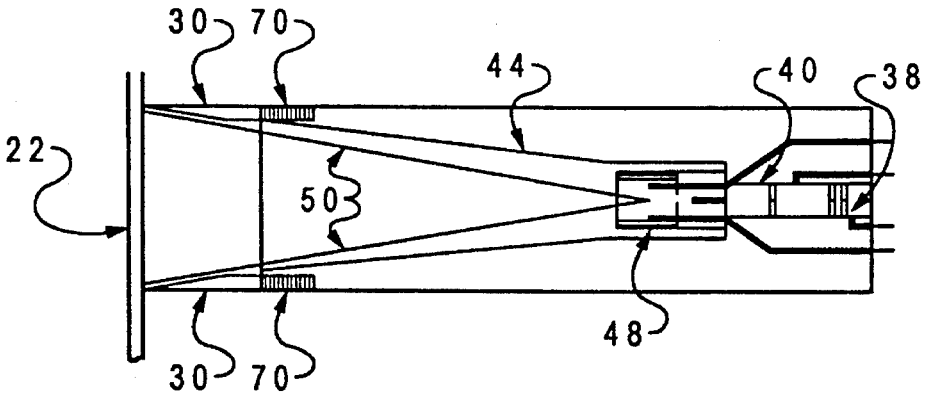

FIG. 5 and 6 illustrate additional construction details of a single gun and deflection assembly. As will be appreciated by those skilled in the art, this assembly technique is simply repeated for each of the gun and deflection assemblies used in the CRT stack 26.

Shallow rectangular channels are formed into face of the individual molded sheets 52 used to fabricate the overall CRT assembly. They are located at the position shown for internal wiring by reference number 60, 62, 64, 66, and 68. A metal paste may be screened into these depressions and cured to form the final wiring traces. Other method of depositing conductive metal into the channels, or onto the face of the structure, may be used as desired. The wiring traces 60–68 are thus bonded firmly to the underlying nonconductive substrate, and the various conductive parts, such as the second anode 44, and deflection plates 48, are then connected to these wiring traces 60–68. As shown, traces 60 and 62 are connected to two of the deflection plates 48. Corresponding traces (not shown) on the other half of the assembly, provided by a separate molded portion 52, are used to provide connection to the other two deflection plates. Trace 64 is connected to the second anode 44, trace 66 is connected to the first anode 40, and trace 68 is connected to the cold cathode electron gun 38. Other traces can be provided as needed.

Recessed and threaded regions 70 are located at either side of the assembly at the front end. These recessed and threaded regions 70 are used for later placement and height adjustment of the pins 30 used to support the face plate 22.

FIG. 6 shows a cross-section of the same region after assembly. Supporting pins 30 have been threaded into the recessed region 70, and provide point support locations for the face plate 22.

The metal parts within the individual electron gun assembly and deflection plate assembly may be fabricated in the conventional way by metal stamping and forming, and assembled with rigid wire and insulators. These parts may then be snapped into the molded recesses to produce a functional CRT assembly.

As described previously, an important requirement for the assembled device is for the individual CRTs to have uniform performance. This is preferably accomplished with an assembly having as low a cost as possible. With this in mind, a preferred embodiment is to selectively deposit metal film directly onto each of the molded parts. There are three subassemblies for each gun and deflection assembly which will require metal deposition. These are each half of the CRT body itself, before assembly of the various individual sheets 52 into an array, and the deflection plate assembly. One method to deposit metal on these parts is to screen a metal paste into the proper location, followed by curing of such paste. The art of depositing metal on non-conducting parts is well developed, and will result in a superior method of assembly to that of snapping in separately molded parts.

To complete the assembly of the CRT from the various individual parts, preformed solder parts can be placed in molded recesses at each location where electrical contacts between CRT parts and wiring are required. Once the complete assembly has been fabricated, it can then be placed into an oven to melt the solder and complete the various electrical connections.

It will be appreciated by those skilled in the art that the assembly of a display unit such as that described above can be highly automated. The fabrication and production of the nonconductive molded portions can be made very reproducible, highly automated and highly accurate. The various electronic parts, the electron gun, the anodes and deflection plates, can be made by metal deposition to give a highly reproducible, multi-element display device.

In order to ensure that no gap occurs at the locations where one gun and deflection assembly is adjacent to another, each of the guns is preferably designed to slightly overscan its allocated region. The blanking signal is then used to ensure that each gun is turned on for only the appropriate intervals.

Figure 7:
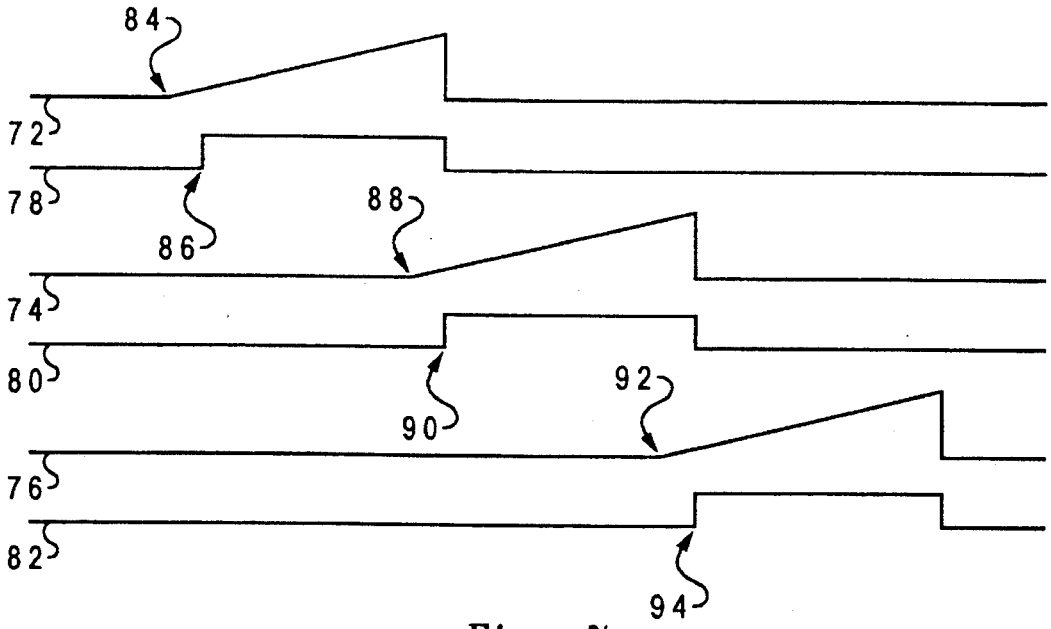
FIG. 7 is a timing diagram illustrating one preferred technique for driving an array such as illustrated in FIG. 2.

FIG. 7 is a timing diagram illustrating this principle for three adjacent gun and deflection assemblies. FIG. 7 illustrates operation of the blanking and horizontal sweep signals for the three assemblies which are horizontally adjacent.

Waveforms 72, 74 and 76 represent the horizontal sweep signal for the three adjacent gun and deflection assemblies. Waveforms 78, 80, 82 represent the blanking signals for the same three assemblies. In the waveforms illustrated, blanking occurs when the blanking signals 78–82 are low and the image is formed on the display when the blanking signals 78–82 are high.

At time 84, the first gun and deflection assembly begins its horizontal sweep. Because the blanking signal 78 is low, no image is yet projected. At time 86, the blanking signal 78 goes high, so that a single horizontal line of the image is swept across the display screen under the control of the horizontal sweep signal 72.

At time 88, the second gun and deflection unit begins its horizontal sweep under the control of horizontal sweep signal 74. Because blanking signal 80 is still low at this time nothing is actually displayed by the second gun and deflection unit. The horizontal sweep signal 74 is calibrated so that it oversweeps the region defined by the first gun and deflection unit. At time 90, blanking signal 80 goes high, so that the second gun and deflection unit begins painting a portion of a horizontal line across the display screen. At the same time, both horizontal sweep signal 72 and blanking signal 78 go low. This means that the first gun and deflection unit ceases to project its portion of the image.

As before, the horizontal line of the overall display continues across the face plate of the display, now controlled by the horizontal sweep signal 74 of the second gun and deflection unit. At time 92, the horizontal sweep signal 76 of the third gun and deflection assembly begins. As before, the sweep signal 76 is calibrated to oversweep into the display area allocated to the second gun and deflection unit. Because the blanking signal 82 is low, however, the third gun and deflection assembly does not paint a portion of the image onto the display at this time.

At time 94, blanking signal 82 goes high and the third gun and deflection assembly begins writing to the screen. As before, the horizontal sweep signal 76 has been calibrated so that the image begins precisely at the edge of the region allocated to the third gun and deflection unit. At the same time 94, the horizontal sweep and blanking signals 74, 80 of the second gun and deflection assembly go low. This causes the second gun and deflection assembly to cease painting to the screen.

Thus, a single horizontal scan has been made across the screen, with each adjacent gun and deflection assembly projecting the appropriate portion of the signal. Starting the sweep signal slightly before the blanking signal enables each gun's beam location (vestigial and real) on the display screen to be superimposed and moving at the same speed. These sweep signals can only perform this task if the physical and electrical characteristics of the individual CRTs are nearly identical. Although they are not shown, the luminescence and other signals used to control data written to the display are connected to each gun and deflection assembly at all times, with the blanking signals used to control when each gun and deflection assembly writes data to the screen.

An alternative technique for ensuring that the horizontal sweep signal is properly handed off from one gun and deflection assembly to the next utilizes only one horizontal sweep signal. In this technique, the horizontal sweep signal has a large peak-to-peak voltage swing. The separate gun and deflection assemblies are biased so that the same sweep signal can be used to drive all of them. For example, the first assembly (leftmost as viewed from the front) is unbiased. As the sweep signal begins to rise, the first gun and deflection assembly generates a scan line in the normal manner. The second assembly is biased by an amount equal to the voltage, V, needed to make a scan across the face of a single gun and deflection assembly. This causes the second assembly to begin scanning across its face just as the first assembly scans up to the boundary between them.

The third gun and deflection assembly is biased with a voltage of 2 V. This causes the third assembly to begin scanning just as the second assembly reaches its right most edge. In a similar manner, each assembly is biased V volts more than the previous assembly, so that the single horizontal scan signal causes the adjacent gun and deflection assemblies to hand off the horizontal scan. This effect is very similar to the first described approach, with the difference that every gun and deflection assembly has an overlap which extends to both sides of the screen. The blanking signals are used in the same manner as described earlier to control which gun and deflection assembly is actually writing to the screen.

The preferred embodiment described above provides for the use of a large number of separate gun and deflection assemblies in a premolded, rigid array. Another approach for providing a multiple gun CRT, presented herein as an alternative embodiment, is illustrated in FIGS. 8 and 9.

Figure 8:
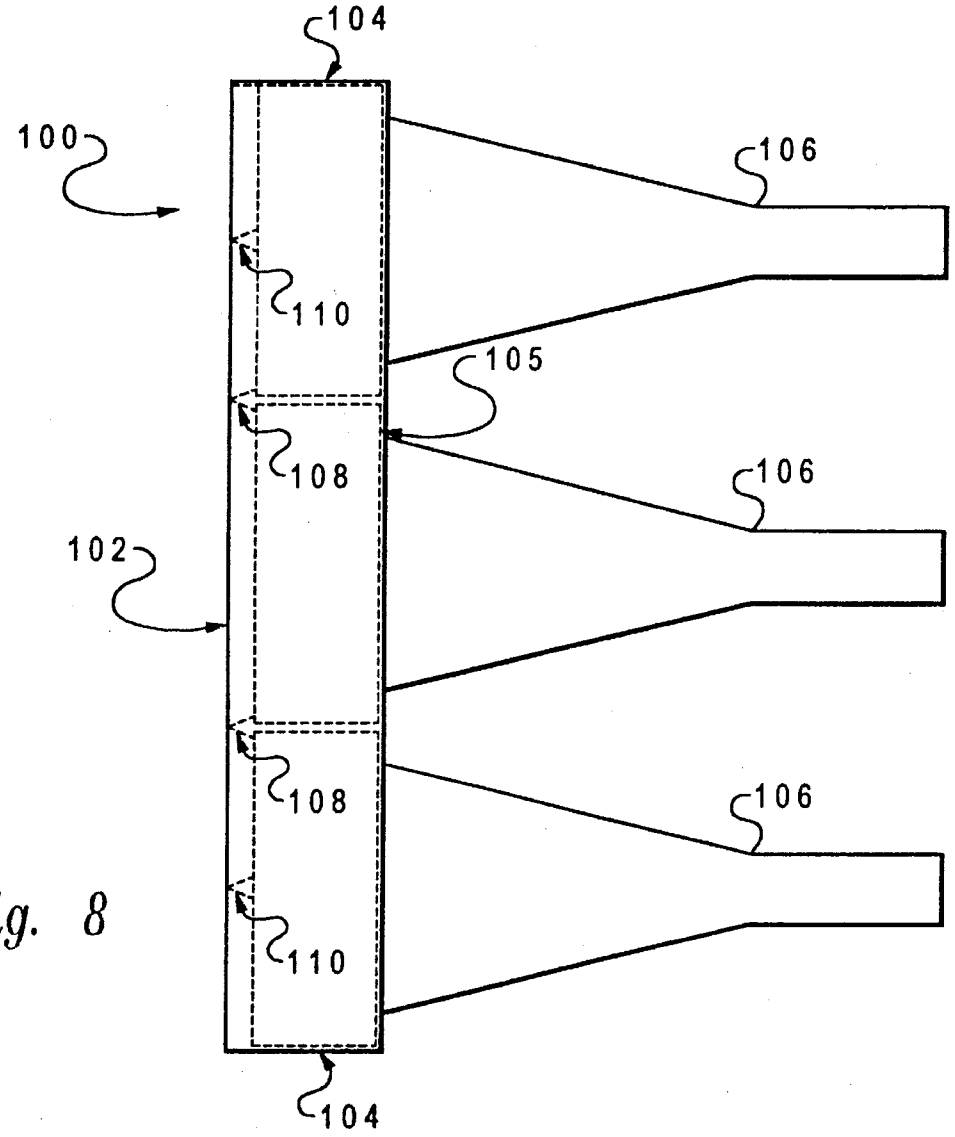
FIG. 8 is a side view of a portion of a multiple gun CRT according to an alternative embodiment of the invention.

Referring to FIG. 8, a multiple gun CRT 100 includes a face plate 102, sidewalls 104 and back plate 105 in a manner similar to that described in the first embodiment. Separate CRTs 106 are connected to the back plate 105 and sealed to provide a vacuum in the interior. Each CRT 106 is a separate device having an electron gun and deflection plates (not shown), or magnetic deflection coils, as known in the art. A grid framework is provided in the interior of the multigun CRT 100, and used to support the flat face plate 102. Pressure on the flat face plate 102 is supported by pins 108, 110 to the backside of the face plate. These pins 108, 110 are located along the lines of adjacency between the sweep patterns covered by the individual CRTs.

Figure 9:
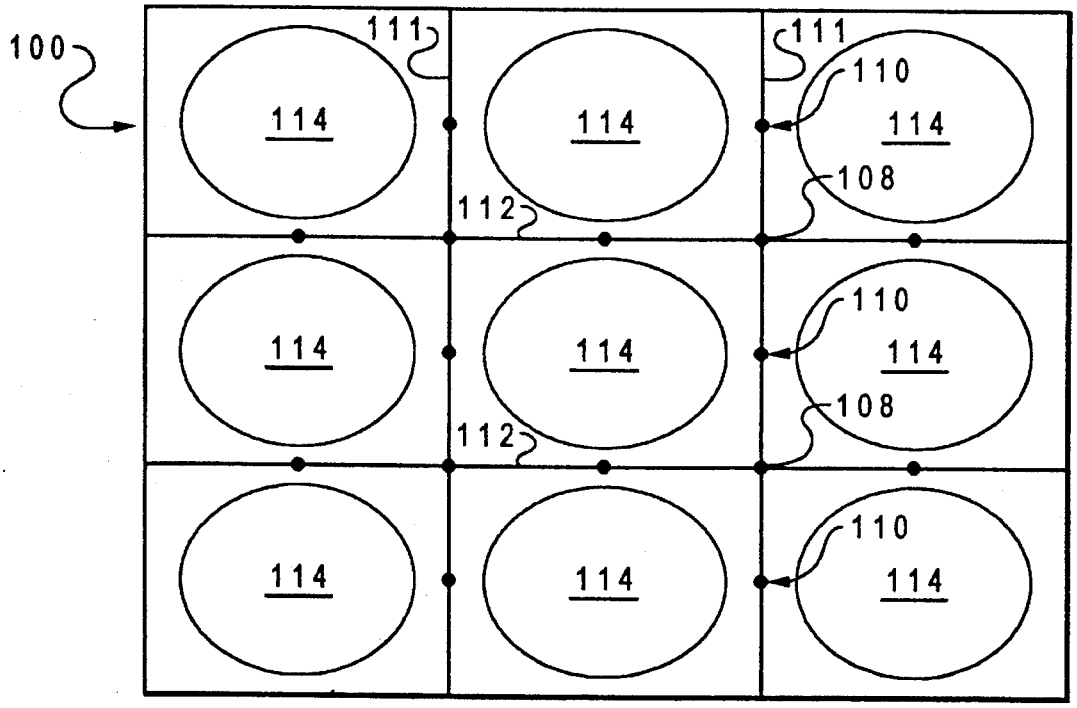
FIG. 9 is a front view of the alternate embodiment of FIG. 8.

FIG. 9 shows a front view of the same device. This is a front view through the face plate into the interior of the multigun CRT. This particular example is formed from a 3×3 grid of CRTs, each having the same 4:3 aspect ratio as the overall display. A framework constructed from vertical supports 111 and horizontal supports 112 is located within the interior of the CRT device, and provides a supporting skeletal structure for both the separate CRTs 106 and the sidewalls and face plate 104 and back plate 105. Pins 108, 110 are connected to the supporting frame and make point contacts with the face plate 102. These pins provide support, through the interior frame, to the face plate, allowing it to be flat. The frame, made up of the supports 111, 112, extends through the interior chamber of the device to the backside between the separate CRTs 106. This provides the complete support necessary to allow a perfectly flat face plate 102. Openings 114 in the back wall of the multigun device 100 are provided for attachment of the individual CRTs 106. The individual CRTs are sealed to the back wall, providing for evacuation of the front chamber containing the frame, and the cone shaped regions of the individual CRTs 106. Flanges (not shown) can be provided for the individual CRTs to attach to the framework, allowing them to be positioned accurately and anchored solidly.

The second embodiment, described in FIGS. 8 and 9, is similar to the first embodiment in that multiple CRTs are used to form a single, larger display. However, it utilizes a grid framework for attachment of individual CRTs as opposed to molding of many individual, small gun and deflection assemblies. The rear portions of the individual CRTs 106 are standard design CRTs, without face plates, and are designed to withstand atmospheric pressure. This is not a concern for the individual gun and deflection assemblies of the first embodiment.

The alternative designs described herein each have strengths and weakness relative to each other. The first design can be manufactured relatively cheaply, despite the large number of individual gun and deflection assemblies, because a few different parts are made in large quantities. Also, the rigid, molded framework provides a strong support structure. However, the technology used is somewhat different from that currently used in CRT design. The second embodiment utilizes technology currently available, and can more easily be incorporated into an existing product line.

As a production start up, the second embodiment requires less engineering design and reduced tooling. The framework can use simple jigs, and be manufactured from float glass, with the use of frit to make the assembly. The individual CRTs can use 3 inch gun and deflection assemblies cut down to fit with the design. A very useful display can be manufactured using this approach.

For example, a configuration as shown in FIGS. 8 and 9 can have individual CRTs which produce a 1.5×2 inch pattern. These can be assembled to make a 40 inch diagonal display approximately 8 to 10 inches in depth. The display would utilize an array of 16×16 small CRTs, with a flat display screen having dimensions of 24×32 inches. Such an assembly, being less than 12 inches thick, would be useful in a large bookcase TV set.

If desirable, it is possible to provide a structure which is somewhat of a combination of these ideas. For example, instead of a molded framework for use with the first embodiment, somewhat of a skeletal structure can be formed by combining a large number of standard gun and deflection assemblies (as found in the small CRTs) into a large matrix interconnected by stiff wire with insulators as required. In addition, structural support members can be added to support the atmospheric pressure loads on the face plate, side plates, and back walls. After this assembly is installed, aligned and evacuated, it would perform as a large screen display.

Thus, the precise nature of the framework used to support the multiple gun and deflection assemblies is not critical, so long as it provides the requisite support for the outer walls of the device against atmospheric pressure, and a means for accurately aligning the individual gun and deflection assemblies. Especially in the first embodiment, the design of the individual gun and deflection assemblies need not take into account the effect of atmospheric pressure, inasmuch as the atmospheric pressure load is borne by the framework rather than the gun and deflection assemblies themselves.

While the invention has been particularly shown and described with reference to a preferred embodiment, it will be understood by those skilled in the art that various changes in form and detail may be made therein without departing from the spirit and scope of the invention.

What is claimed is:

1. A multigun cathode ray tube apparatus, comprising:

a plurality of exterior walls providing a sealed, evacuated interior, one of such walls providing a face plate with phosphors which emit light in response to being struck by an electron beam, and another of such walls providing a planar back plate, wherein the sealed, evacuated interior region is defined to be the region between the front and back plates;

a non-conductive support frame wholly contained within the sealed interior, such support frame providing structural support for the exterior walls against atmospheric pressure; and a plurality of electron gun and deflection units connected to the frame, wherein the gun and deflection units are wholly contained between the front and back plates, and are supported by the frame in a fixed and rigid relationship and operative to project electron beams against the face plate.

2. A multigun cathode ray tube apparatus, comprising:

a plurality of exterior walls providing a sealed, evacuated interior, one of such walls providing a face plate with phosphors which emit light in response to being struck by an electron beam;

a non-conductive support frame in the sealed exterior, such support frame providing structural support for the exterior walls against atmospheric pressure; and a plurality of electron gun and deflection units connected to the frame, wherein the gun and deflection units are supported by the frame in a fixed and rigid relationship and operative to project electron beams against the face plate;

wherein each gun and deflection unit includes:

an electron gun for emitting a beam for electrons;

a plurality of deflection plates for controlling the path of the emitted beam; and at least one anode for accelerating the electron beam toward the face plate.

3. The apparatus of claim 2, further comprising:

conductive traces formed on the support frame for connecting electrical signals to the electron gun, anode, and deflection plates.

4. A multigun cathode ray tube apparatus, comprising:

a plurality of exterior walls providing a sealed, evacuated interior, one of such walls providing a face plate with phosphors which emit light in response to being struck by an electron beam, wherein the face plate is flat;

a non-conductive support frame in the sealed exterior, such support frame providing structural support for the exterior walls against atmospheric pressure; and a plurality of electron gun and deflection units connected to the frame, wherein the gun and deflection units are supported by the frame in a fixed and rigid relationship and operative to project electron beams against the face plate.

5. The apparatus of claim 4, further comprising:

a plurality of pins connected to the support frame and projecting toward the face place so as to make contact therewith, wherein the pins support the face plate against atmospheric pressure through the frame.

6. A multigun cathode ray tube apparatus, comprising:

a plurality of exterior walls providing a sealed, evacuated interior, one of such walls providing a face plate with phosphors which emit light in response to being struck by an electron beam;

a non-conductive support frame in the sealed interior, such support frame providing structural support for the exterior walls against atmospheric pressure; and a plurality of electron gun and deflection units connected to the frame, wherein the gun and deflection units are supported by the frame in a fixed and rigid relationship and operative to project electron beams against the face plate;

wherein the plurality of gun and deflection units are wholly contained within the evacuated interior, and wherein the support frame comprises a plurality of essentially identical pieces, each piece molded from a non-conductive material so as to define one-half of two adjacent columns of cavities for receiving a gun and deflection assembly, wherein a plurality of molded pieces are assembled to define an array of cavities each containing one gun and deflection assembly.

7. The apparatus of claim 1, wherein the support frame comprises a skeletal structure containing horizontal and vertical supporting members.

8. The multigun cathode ray tube apparatus of claim 1, wherein each gun and deflection unit comprises:

an electron gun for emitting a beam of electrons;

a plurality of deflection plates for controlling the path of the emitted beam; and at least one anode for accelerating the electron beam toward the face plate.

9. A method for assembling a cathode ray tube device, comprising the steps of:

providing an outer envelope having side plates and a face plate with phosphors which react to the impingement of an electron beam thereon;

forming a supporting frame;

attaching a plurality of electron gun and deflection assemblies to the supporting frame;

inserting the frame into an interior of the outer envelope;

sealing a planar back plate to the outer envelope, wherein the back plate in combination with the outer envelope defines an interior region between the front and back plates; and evacuating the interior region to produce a vacuum, wherein the supporting frame provides support for at least the face plate against atmospheric pressure, and wherein the electron gun and deflection assemblies are wholly contained in the interior region between the front and back plates.

10. A method for assembling a cathode ray tube device, comprising the steps of:

providing an outer envelope having side plates and a face plate with phosphors which react to the impingement of an electron beam thereon;

forming a plurality of essentially identical molded portions each defining one half of a plurality of cavities for holding the gun and deflection assemblies;

assembling the molded portions together to form a supporting frame and to define an array of cavities imbedded in the supporting frame;

attaching a plurality of electron gun and deflection assemblies to the supporting frame;

inserting the frame into an interior of the outer envelope;

sealing a back plate to the outer envelope; and evacuating the interior of the envelope to produce a vacuum, wherein the supporting frame provides support for at least the face plate against atmospheric pressure.

* * * * *